United States Patent [19]

Bulman et al.

[11] 4,043,248

[45] Aug. 23, 1977

[54] LIQUID PROPELLANT GUN (RECOILLESS REGENERATIVE PISTON)

[75] Inventors: Melvin John Bulman, Shelburne; Alfred Rapp Graham, Burnt Hills, both of Vt.

[73] Assignee: General Electric Company, Burlington, Vt.

[21] Appl. No.: 694,870

[22] Filed: June 10, 1976

[51] Int. Cl.[2] ..... F41F 15/00

[52] U.S. Cl. ..... 89/1.703; 89/1.704; 89/7

[58] Field of Search ..... 89/7, 9, 1.703, 1.704; 417/377, 381

[56] References Cited

U.S. PATENT DOCUMENTS

| | | | |
|---|---|---|---|
| 2,924,149 | 2/1960 | Musser | 89/1.703 |
| 2,965,000 | 12/1960 | Skinner | 89/7 X |
| 2,981,153 | 4/1961 | Wilson et al. | 89/7 |
| 2,986,072 | 5/1961 | Hudson | 89/7 |
| 3,129,636 | 4/1964 | Strickland et al. | 89/1.703 |
| 3,138,990 | 6/1964 | Jukes et al. | 89/7 |

*Primary Examiner*—David H. Brown
*Attorney, Agent, or Firm*—Bailin L. Kuch

[57] ABSTRACT

A liquid propellant gun has a combustion chamber which receives liquid propellant from a differential piston operating in a supply chamber, has a gun barrel for the discharge of a projectile, and a balancing nozzle for the discharge of combustion gas. The effective open cross-sectional area of the balancing nozzle is controlled by a plug coupled to the differential piston so that at the start of combustion the nozzle is substantially closed, is subsequently progressively opened in a controlled manner independent of the displacement of the projectile, and is finally fully opened or closed.

14 Claims, 6 Drawing Figures

LIQUID PROPELLANT GUN (RECOILLESS REGENERATIVE PISTON)

BACKGROUND OF THE INVENTION

1. Field of the Invention

This invention relates to liquid propellant guns utilizing a differential piston to provide continued or regenerative injection of the propellant into the combustion chamber after initial ignition, and more particularly to such guns having a balancing nozzle for recoilless operation.

2. Prior Art

Liquid propellant guns utilizing differential pistons to pump propellant into the combustion chamber during combustion are now well known. Early work is described in a Final Report of Nov. 19, 1953–Jan. 31, 1956 under contract DA-36-034-ORD-1504RD, Project TS1-47-8 by V. M. Barnes, Jr. et al which apparently in part corresponds to Jukes et al, U.S. Pat. No. 3,138,990 filed Oct. 9, 1961; in a report No. 17-2 of June 15, 1954 under contract NOrd-10448 by C. R. Foster et al; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr., et al, U.S. Pat. No. 2,981,153, filed Nov. 14, 1952; C. M. Hudson, U.S. Pat. No. 2,986,072, filed Nov. 19, 1952; and E. J. Vass, et al, U.S. Pat. No. 3,690,255, filed Oct. 1, 1970.

Guns utilizing balancing nozzles to approximate recoilless operation are also now well known. Examples are: C. W. Musser, U.S. Pat. No. 2,924,149, filed Oct. 7, 1957; L. A. Skinner, U.S. Pat. No. 2,965,000, filed Dec. 20, 1960; R. G. Strickland et al, U.S. Pat. No. 3,129,636, filed Sep. 28, 1960; and A. J. Grandy, U.S. Pat. No. 3,338,133, filed Oct. 6, 1965. Musser and Grandy show the use of a frangible disk to close the balancing nozzle until pressure has built up in the combustion chamber. Strickland et al shows a plug attached to the projectile to restrict the balancing nozzle prior to translation of the projectile down the gun barrel. That is, to restrict the flow of exhaust combustion gas through the nozzle during the early phases of the combustion process in the recoilless gun. This restriction causes more rapid pressure buildup and higher acceleration for the projectile. However, the plug is attached to the projectile and this restriction it provides only occurs when the projectile is near the beginning of the gun barrel. Since the projectile has a very high initial acceleration, the plug is in the vicinity of the nozzle for only a very short initial period.

An object of this invention is to provide a recoilless gun wherein the rate of exhaust flow of the combustion gas through the balancing nozzle can be controlled over a major fraction of the combustion period, thereby to permit a more absolute balance of the forces of recoil and counterrecoil to provide a truly recoilless gun.

Another object of this invention is to provide a recoilless gun where the rate of exhaust flow of the combustion gas through the balancing nozzle can be controlled to reduce the blast field generated by the exhaust flow to a desired level. By blast field is meant the shock wave or waves generated in the volume or region of atmosphere surrounding the rear of the gun which is generated by the rapid introduction therein of the large volume of exhaust gas. Controlling the rate of introduction of this gas directly controls the strength of this shock wave and its overpressure.

A feature of this invention is the provision of a liquid propellant gun having a combustion gas responsive displacement mechanism to progressively inject propellant into a combustion chamber from a supply chamber, a gun barrel for the discharge of a projectile, a balancing nozzle for the discharge of combustion gas, and a plug coupled to said mechanism and serving to control the effective cross-section area of said nozzle in response to the displacement of said mechanism.

BRIEF DESCRIPTION OF THE DRAWING

These and other objects, advantages and features of the invention will be apparent from the following specification thereof taken in conjunction with the accompanying drawing in which.

DESCRIPTION OF THE INVENTION

The invention, as shown in figures, may be incorporated in a liquid propellant gun having a differential area piston for progressively injecting propellant from a supply chamber into a combustion chamber, as shown in Ser. No. 694,866, filed June 10, 1976 by A. R. Graham, and obtaining satisfactory damping through the devices shown in Ser. No. 694,867, filed June 10, 1976 by D. P. Tassie and Ser. No. 694,868, filed June 10, 1976 by A. R. Graham. The controlled leakage mechanism described in Ser. No. 694,866, above, may also be used to advantage herein.

Figure 1:
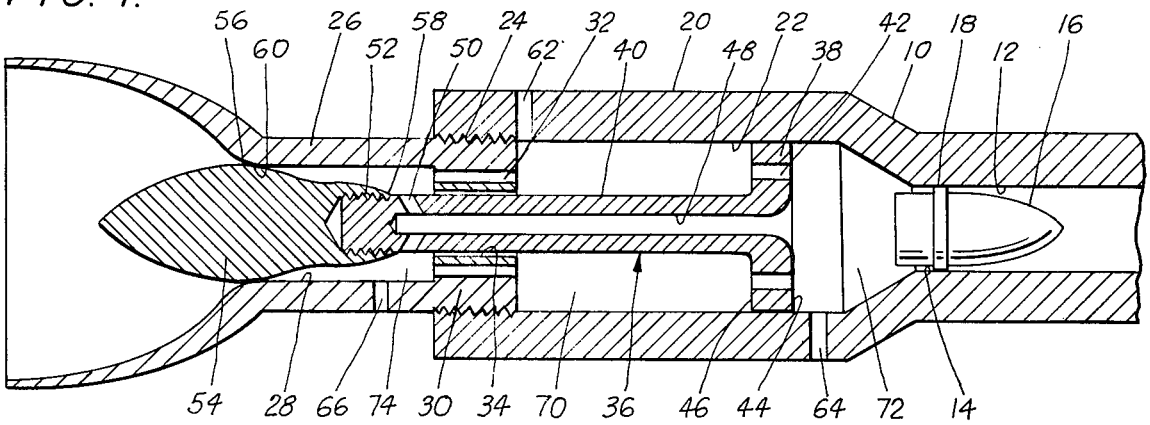
FIG. 1 is a schematic diagram of a gun having a coaxial gun barrel, a differential piston and a balancing nozzle embodying the present invention.

As shown in FIG. 1, the invention is embodied in a gun having a gun barrel 10 with a rifled bore 12 and a chamber 14 receiving a projectile 16 having a rotating band 18. The gun barrel extends aftwardly to form a cylinder 20 having a bore 22, to which is fixed, as by a theaded joint 24, a balacing nozzle 26 having a throat 28 and a transverse wall 30 with a plurality of longitudinal bores 32 disposed about a central longitudinal bore 34. A differential piston 36 has a head 38 journaled for reciprocation in the bore 22 and a stem 40 journaled for reciprocation in the bore 34. The head has a plurality of longitudinal bores 42 extending from the forward face 44 of relatively large cross-sectional area to the aft face 46 of relatively small cross-sectional area. The stem has a longitudinal blind bore 48 extending aftwardly from the forward face 44 and intersected at its aft end by a plurality of radial bores 50. The aft end of the stem is fixed, as by a threaded joint 52, to an enlarged cylindrical plug 54 which is journaled for reciprocation in the throat 28. The plug may be of any desired longitudinal configuration, from a maximum diameter at transverse plane 56 to a minimum diameter at transverse plane 58 so that as a function of the longitudinal aftward displacement of the plug from the position shown in FIG. 1, a minimum open annular cross-section area (shown as zero in FIG. 1) is provided at the knee 60 to a maximum open annular cross-sectional area. A port 62, in the cylinder 20, for the entry of liquid propellant, a forward port 64 and an aft port 66 for respective sources of ignition are also provided.

The piston head 38, the wall 30 and the bore 22 define a supply chamber 70 for liquid propellant; the piston head 38, the bore 22 and the projectile 16 define a forward combustion chamber 72; the wall 30, the throat 28 and the plug 54 define an aft combustion chamber 74. At the beginning of a cycle the piston head is aft and adjacent to the wall 30. A projectile is inserted into the projectile chamber 14. Liquid propellant is introduced under pressure through the port 62, as by a check valve, not shown, to progressively displace the piston head forwardly, increasing the volume of the supply chamber and decreasing the volumes respectively of the forward and aft combustion chambers. In this process a small quantity of propellant leaks through the bores 42 and 32 into the forward and aft combustion chambers and serves as a primer which is subsequently ignited by ignition sources operable through ports 64 and 66 after the piston head has reached its forwardmost position, as shown in FIG. 1, whereat the plug has minimized the annular opening of the throat of the balancing nozzle.

Upon ignition the combustion chamber gas in the forward combustion chamber acting on the relatively large cross-sectional area of the face 44 of the piston head 38 commences to displace the piston aft, which injects more propellant through the bores 42 and 32. At this time the aft and forward combustion chambers are a substantially closed system, and combustion gas pressure builds up without venting. As the piston moves aft with the plug 54, the throat of the balancing nozzle is progressively opened, permiting the flow of combustion gas out the nozzle from the forward combustion chamber, through the piston bore 48 and bores 50 together with that combustion gas which is generated itself in the aft combustion chamber.

It may be noted the bores 32 and 66 and the combustion in the aft chamber 74 may all be omitted, and all of the balancing gas flow may be provided from the forward chamber 72.

It may also be noted that the regenerative piston, due to the resistance of flow of the liquid propellant through the bores 42 and 32 providing a hydraulic damping function, has a much lower acceleration and a velocity which is an order of magnitude more slower than the projectile. Thus the control exercised over the balancing nozzle by the plug 54 on the regenerative piston can be essentially extended over nearly the full time the projectile is in the gun barrel.

Figure 2:
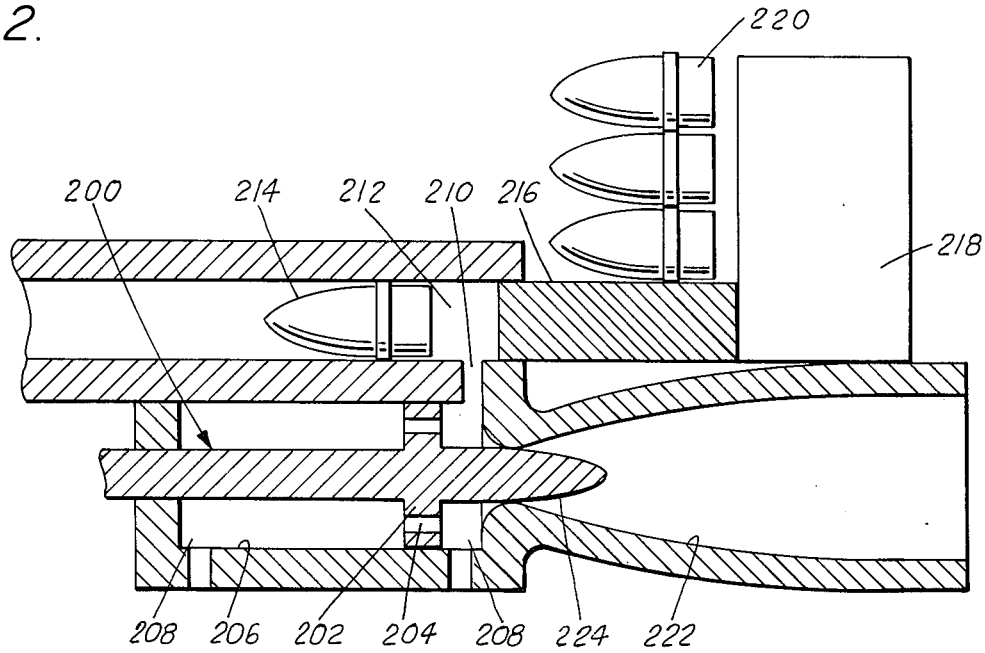
FIG. 2 is a schematic diagram of a gun having a gun barrel with an ammunition feeding mechanism parallel to a differential piston and a balancing nozzle embodying the present invention.
Figure 3:
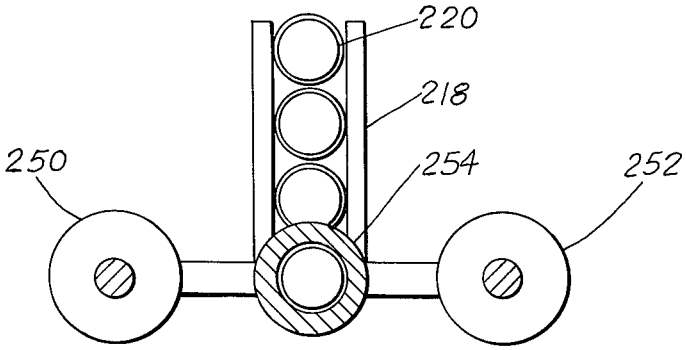
FIG. 3 is a schematic diagram of a gun similar to that of FIG. 2 having a plurality of sets of differential pistons and balancing nozzles disposed in a circular row coaxial to a gun barrel with an ammunition feeding mechanism.

The longitudinal axis of the regenerative piston may be displaced from the longitudinal axis of the gun barrel to make the chambering of projectile more convenient, as shown in FIG. 2. The differential piston 200 has a piston head 202 with injection bores 204 journaled in a cylinder 206 and defining a liquid propellant supply chamber 206 and a combustion chamber 208. The combustion chamber vents through a port 210 into the projectile receiving chamber 212 aft of the projectile 214 and forward of the gun bolt 216. The bolt is operated by a conventional bolt operating mechanism 218 to strip the lowermost projectile from a train of projectiles 220, to chamber the projectile and to close the chamber. The combustion chamber also vents to a balancing nozzle 222 which is coaxial to the piston. A plug 224 is fixed to the piston to constrict the opening of the nozzle at the commencement of combustion. The non-coaxial arrangement of FIG. 2 develops a force couple, which may be avoided by providing two or more sets 250, 252 of pistons and balancing nozzles to provide a balance of forces with the gun barrel 254, as shown in FIG. 3. Use may be made of the scaling mechanism disclosed in Ser. No. 694,869 filed June 10, 1976 by A. R. Graham.

Figure 4:
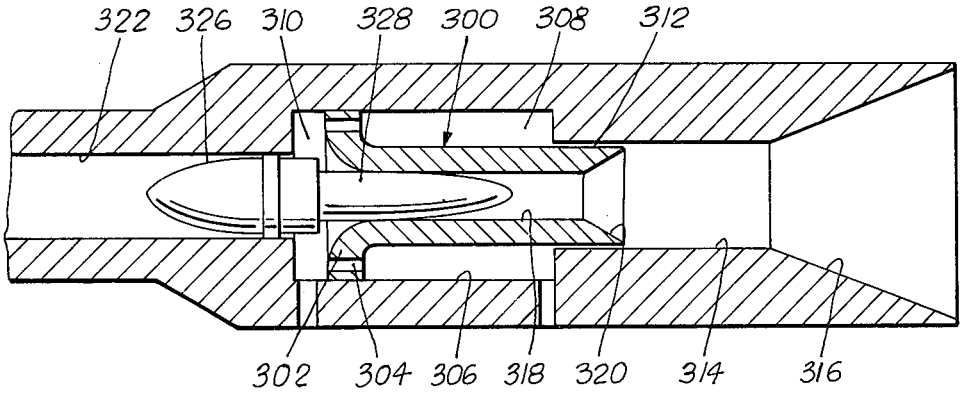
FIG. 4 is a schematic diagram of an additional species of the invention having the differential piston as part of the balancing nozzle.

The differential piston 300 may be utilized as part of the balancing nozzle, as shown in FIG. 4. The piston has a piston head 302 with injection bores 304 journaled in a cylinder 306 and defining a liquid propellant supply chamber 308 and a combustion chamber 310. The piston has a piston stem 312 which is journaled in the bore 314 of a balancing nozzle 316, and has a longitudinal bore 318 running the entire length of the piston, terminating in an initial nozzle 320. The combustion chamber 310 vents forwardly through the gun barrel bore 322, and aftwardly through the piston bore 318, nozzle 320, and the balancing nozzle 314, 316. Each projectile 326 is provided with an aftwardly extending plug 328 to constrict the piston bore 318 at the commencement of combustion. In a system wherein a peak pressure of 20,000 psi is reached in the combustion chamber, the projectile does not complete the engraving of its rotating band and move significantly forward from the projectile chamber until an intermediate pressure of about 10,000 psi has been reached, The differential piston is able to slide aftwardly before that intermediate pressure has been reached, so that a progressive development of the aftward exhaust may be provided before the projectile leaves the projectile chamber. This present arrangement is an improvement over the prior known arrangement of a plug fixed to the aft end of the projectile and extending into a fixed housing balancing nozzle because the prior arrangement can only vary the nozzle throat cross-sectional area when the projectile is moving. In the present arrangement the nozzle throat area can be varied when either the piston or the projectile is moving, until they separate. Since the flow may be required to build up over a long time prior to any movement of the projectile, the present arrangement better meets this requirement than the prior arrangement did. Further, the present arrangement provides improved ballistic efficiency. The plug extends into the low pressure volume in and beyond the nozzle, reducing the cross-sectional area of the base of the projectile which is exposed to the higher pressure of the combustion chamber. Thus the initial force on the base of the projectile is lower than would be the case if chamber pressure were applied to the full area of the base. In this way the applied force can be maintained below that required to commence the translation of the projectile up the barrel, and thus prolong the period of nozzle area control. It is possible to hold the projectile stationary until peak chamber pressure is reached. Since the force on the base of the projectile increases as the plug is withdrawn from the bore of the piston, the acceleration of the projectile will increase rapidly. A fast rise in acceleration provides a higher average acceleration and thus a high projectile velocity.

Figure 5:
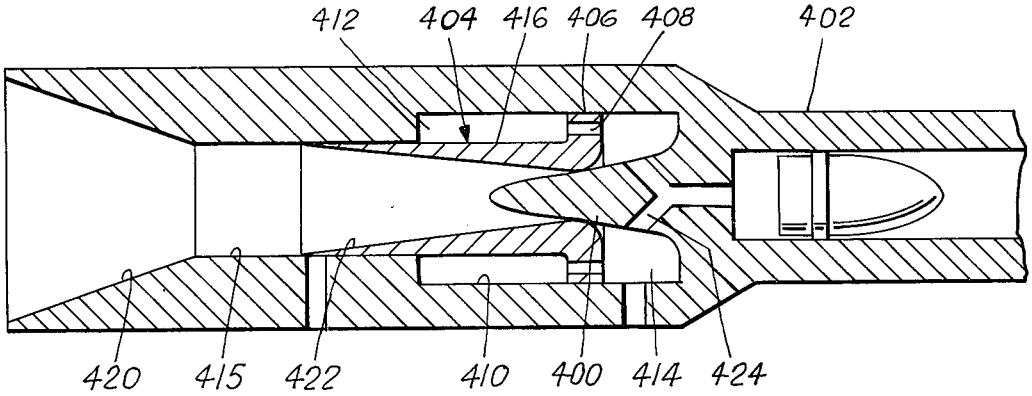
FIG. 5 is a schematic diagram of a variation of the species of FIG. 4.

The plug 400 may be fixed to the housing 402 or some other part which is stationary during the combustion period, as shown in FIG. 5. The differential piston 404 is utilized as part of the balancing nozzle. The piston has a piston head 406 with injection bore 408 journaled in a cylinder 410 and defining a liquid propellant supply chamber 412 and a combustion chamber 414. The piston has a piston stem 416 which is journaled in the bore 415 of a balancing nozzle 420, and has a longitudinal bore 422 running the entire length of the piston and serving as an initial nozzle. A plurality of bores 424 communicate between the combustion chamber and the projectile chamber. The combustion chamber vents forwardly through the bores 424 and aftwardly through the piston bore 422 and the balancing nozzle 420. The plug 400 restricts the piston bore 422 at the commencement of combustion. The cross-sectional area of the bores 424 may be used to reduce the gas pressure from the combustion chamber to the projectile chamber. For example, the combustion chamber may be permitted to peak of 50,000 psi, while the projectile chamber may be permitted a peak of 10,000 psi. The higher the pressure, the faster the rate of burning, the higher the velocity of the exhaust jet and the smaller the diameter of the exhaust jet as it passes from the balancing nozzle into the atmosphere.

Figure 6:
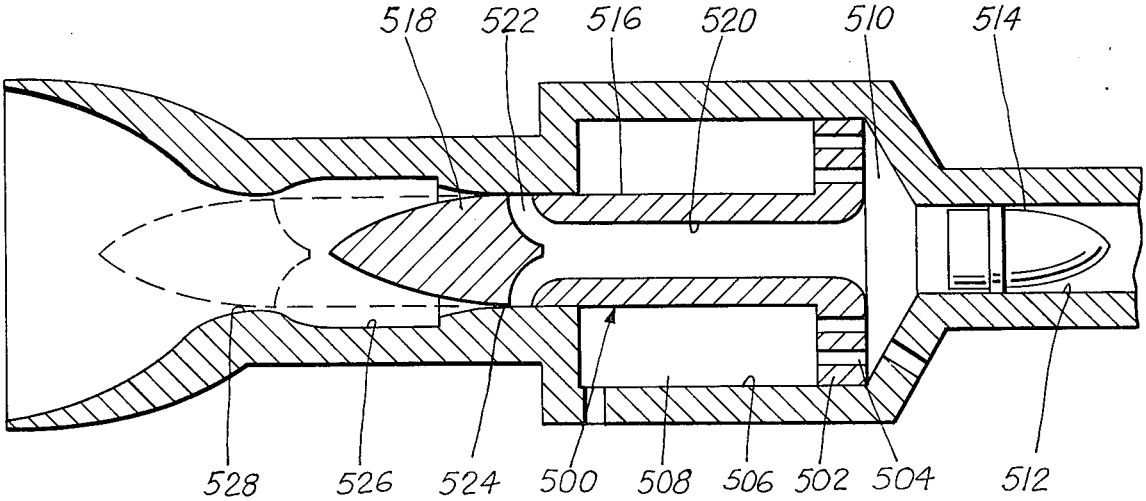
FIG. 6 is a schematic diagram of a variation of the species of FIG. 1.

The plug on the piston may be used to provide complex control of the exhaust jet as shown in FIG. 6. The differential piston 500 has a head 502 with injection bores 504 journaled in a cylinder 506 and defining a liquid propellant supply chamber 508 and a combustion chamber 510, which lead to a chamber 512 for receiving a projectile 514. The piston has a stem 516 which terminates in a plug 518, and a blind bore 520 which communicates from the combustion chamber to a plurality of radial bores 522, and is journaled in a bore 524 which terminates in a balancing nozzle 526 which has an aft constriction 528. At the commencement of combustion the piston is in its forwardmost position and the bores 522 are closed by the wall of the bore 524. Rearward displacement of the piston and its plug permits the increasing flow of exhaust gas out the balancing nozzle until the plug approaches the constriction 528 which decreases the flow.

It will be seen that use of the piston of displace the plug permits the exhaust flow of the balancing nozzle to be made independent of the pressure behind the projectile. The plug can control the effective open area of the balancing nozzle independently of the rapid pressure rise required in the combustion chamber. In operation, the exhaust nozzle may start from a closed condition, then have a slowly increasing area as the pressure gradually builds up, and then at a predetermined time have a rapidly decreasing area which will cause a rapidly increasing pressure buildup in the combustion chamber to provide the required acceleration of the projectile from the gun barrel without causing a sudden increase in the outflow through the balancing nozzle which would cause a blast or shock wave.

What is claimed is:

1. A gun comprising:
a gun barrel;
a combustion chamber;
a liquid propellant supply chamber;
first means having a displacement which is a time function for injecting propellant from said supply chamber into said combustion chamber as a function of said displacement;
a balancing nozzle having a throat
valve means communicating between said combustion chamber and said balancing nozzle throat for providing a conduit for the flow of combustion gas, and coupled to said first means for controlling said flow as a function of said displacement of said first means.

2. A gun according to claim 1 wherein:
said displacement of said first means is a function of the pressure of the gas in said combustion chamber.

3. A gun according to claim 1 wherein:
said first means includes a regenerative piston.

4. A gun according to claim 3 wherein:
said piston and said gun barrel are coaxial.

5. A gun according to claim 3 wherein:
said valve means includes
a longitudinal bore in said piston communicating between said combustion chamber and said nozzle throat.

6. A gun according to claim 5 wherein:
said valve means includes
a projectile disposed in said gun barrel.
a plug fixed to said projectile and extending into said piston bore which serves as a portion of said nozzle throat.
said projectile and piston having a mode of operation such that said piston is adapted to move aft away from said plug prior to said projectile moving forwardly in said gun barrel.

7. A gun according to claim 5 further including:
a housing; and
said valve means includes
a plug fixed to said housing and extending into said piston bore which serves as a portion of said nozzle throat.

8. A gun according to claim 3 wherein:
said valve means includes
a plug fixed to said piston and journaled for reciprocation within said nozzle throat and effective to change the open cross-sectional area of said nozzle throat.

9. A gun according to claim 8 wherein:
said nozzle throat has first and second constrictions which are longitudinally spaced apart,
said plug cooperating initially with said first constriction and subsequently, upon displacement by said piston, with said second constriction.

10. A gun according to claim 8 further including:
an additional combustion chamber;
said piston additionally serving to inject propellant into said additional combustion chamber;
said valve means additionally serving to communicate between said additional combustion chamber and said nozzle throat.

11. A gun according to claim 10 wherein said combustion chambers and said piston are mutually coaxial.

12. A gun according to claim 8 wherein:
said gun barrel includes a projectile receiving chamber;
means for disposing a projectile in said projectile receiving chamber;
conduit means communicating between said combustion chamber and said projectile receiving chamber for providing a flow of combustion gas.

13. A gun according to claim 12 further including:
an additional set of
combustion chamber;
liquid propellant supply chamber;
nozzle having a throat;
piston and plug;
said conduit means additionally communicating between said additional combustion chamber and said projectile receiving chamber,
said nozzle throats being mutually spaced apart and having longitudinal axes which are parallel to the longitudinal axis of said gun barrel.

14. A gun according to claim 13 wherein:
said axes of said nozzle throats and said gun barrel are substantially coplanar.

* * * * *

UNITED STATES PATENT OFFICE

CERTIFICATE OF CORRECTION

Patent No. 4,043,248 Dated August 23, 1977

Inventor(s) Melvin J. Bulman and Alfred Rapp Graham

It is certified that error appears in the above-identified patent and that said Letters Patent are hereby corrected as shown below:

[75] Inventors: Melvin John Bulman, Shelburne, Vermont
Alfred Rapp Graham, Burnt Hills, New York Column 2,
line 64 change "enlarged" to --elongated--.
Column 3, line 3 change "cross-section" to --cross-sectional--; line 25 after "through" insert --the--; line 29 delete "chamber"; line 51 after "magnitude" insert --or--.
Column 5, line 14 change "to" to --a--; line 38 change "piston of" to --piston to--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*